US007703449B2

(12) United States Patent
Wright

(10) Patent No.: US 7,703,449 B2
(45) Date of Patent: Apr. 27, 2010

(54) LIMB DAMPENERS

(75) Inventor: Stuart Duane Wright, Hayden, ID (US)

(73) Assignee: Stuart D. Wright, Hayden, ID (US)

( * ) Notice: Subject to any disclaimer, the term of this patent is extended or adjusted under 35 U.S.C. 154(b) by 419 days.

(21) Appl. No.: 11/379,554

(22) Filed: Aug. 1, 2007

(65) Prior Publication Data

US 2009/0032005 A1 Feb. 5, 2009

(51) Int. Cl.
*F41B 5/20* (2006.01)

(52) U.S. Cl. ..... 124/89

(58) Field of Classification Search ..... 124/86, 124/89, 92; 188/378; 267/136, 137
See application file for complete search history.

(56) References Cited

U.S. PATENT DOCUMENTS 3,059,629 A * 10/1962 Stinson ..... 124/23.1
5,362,046 A * 11/1994 Sims ..... 473/300
6,257,220 B1 * 7/2001 McPherson et al. ..... 124/89
6,298,842 B1 * 10/2001 Sims ..... 124/89
6,382,201 B1 * 5/2002 McPherson et al. ..... 124/89
6,526,957 B1 * 3/2003 Leven ..... 124/89
6,684,870 B1 * 2/2004 Land ..... 124/23.1
6,684,874 B2 * 2/2004 Mizek et al. ..... 124/89
6,712,059 B2 * 3/2004 Donovan ..... 124/89
6,758,205 B2 * 7/2004 Kronfeld ..... 124/89
6,761,158 B2 * 7/2004 Wright ..... 124/92
6,910,472 B2 * 6/2005 Mizek et al. ..... 124/89
6,941,937 B2 * 9/2005 Wheeler ..... 124/23.1
2003/0094168 A1 * 5/2003 Sims ..... 124/89

* cited by examiner

*Primary Examiner*—John Ricci

(57) ABSTRACT

Disclosed is a device made of a soft, flexible elastomer with freely movable members for use as a vibration dampener on an archery bow limb. Upon release of an arrow from an archery bow, the damper members reactively contact and rebound against the bow limb. The device can be installed on a mount to attach to both solid limb and split limb bows at the same general location on both the top and bottom limbs to greatly reduce the duration of vibration, the amount of hand shock and perceived noise generated upon release of an arrow from an archery bow.

5 Claims, 11 Drawing Sheets

LIMB DAMPENERS

THE FIELD OF THE INVENTION

The present invention is a device used for dampening vibrations of a bow limb after the release of an arrow from an archery bow.

BACKGROUND OF INVENTION

Archery bows generate excessive noise when fired due to the considerable amount of vibration of the archery bow limbs. Other bow limb vibration dampeners position the greater mass of the elastomer device at the end furthest from the mount. This allows the greater mass of the device to wiggle and jiggle in free space without making contact with the bow limb. Although these devices were effective in reducing vibrations in older bows, they are not as effective when attached to newer bows that have a generally parallel limb arrangement. This is due to the unique forces placed on the bow limbs upon the release of an arrow from an archery bow. The reason that more manufactures have started using this parallel limb mounting arrangement is because it has been observed that hand shock, vibration and noise are reduced.

There exist a need for more modern compound bows with parallel and non-parallel limbs to place the elastomer dampening device closer to the surface of the archery bow limb to allow symmetric and asymmetric rebounding of the device against the surface of the bow limb. It has been observed that the actions of the device upon firing an arrow from an archery bow will greatly reduce the duration of vibrations, hand shock and perceived noise in the archery bow.

DISCUSSION OF PRIOR ART

When a high performance archery bow releases an arrow from full draw most of its stored energy is transferred to the arrow. The arrow is accelerated from full draw of the archery bow to its undrawn state, thus sending the arrow down range to its target. Due to the dynamics of a high performance archery bow not all of the stored energy is transferred to the arrow, but instead some of this energy is transferred to the limbs which impart vibrations throughout the bow causing unwanted noise and hand shock to archer's hand.

Inventors over the years have developed stabilizers that mount to the riser of an archery bow by means of a threaded fastener. Some of these stabilizers incorporate dampening devices installed both internally as well as externally. Hydraulic cylinders filled with oil, with or without pistons, with or without springs on either side as well as pneumatic/oil systems were designed. Other inventions used a simple tube and filled it with gel with or without some form of a solid media suspended in the compound. Many combinations of elastomeric polymers were also used in either in a stationary device or employed in conjunction with some form of a mechanical device. While a good number of these products work well to reduce vibration as well as hand shock, they are mounted a considerable distance from the tips of the bow limbs where the dynamics of vibration are the greatest upon the release of an arrow from an archery bow.

A later invention, U.S. Pat. No. 6,257,220 McPherson (2001) places vibration dampening modules inside of riser at both the top and bottom of riser beneath limb attachment bolts. This proved to help reduce some vibration and noise. U.S. Pat. No. 6,588,414 McMillian III (2003) mounted a soft polymer insert through the riser handle where the stabilizer could be threaded into an insert isolated from the riser. While these devices help reduce noise and vibration to a certain extent, these devices were still mounted a distance from the limb tips. U.S. Pat. No. 6,526,957 Leven (2003) describes the use of the device to attach a stabilizer to the end of the limb fastened to the riser with the limb bolts. This device in pairs would also help reduce vibration to an extent, but would make the bow more cumbersome in the field as well as increase the overall weight of the bow.

Another patent for vibration dampening devices used for sporting good implements and hand tools, U.S. Pat. No. 5,362,046 Sims (1994). This patent is restricted for use with "implements", as defined in Sims patent, "wielded devices designed to impart and receive impacts including but not limited to: golf clubs, baseball and softball bats, tennis rackets, and hammers." Later U.S. Pat. No. 5,772,541 Buiatti (1998) describes the invention as being used on hand held implements such as ball bats, golf clubs, and for the first time archery bow limbs from claim 12.

Due to the development in recent years of lower durometer elastomeric polymers with relatively higher tensile strengths, there have been several vibration damper inventions made that install on an archery bow string. U.S. Pat. No. 6,237,584 Sims (2001) known to the archery industry as "Leaches" and U.S. Pat. No. 6,761,158 Wright (2004) a prior art of the inventor known to the archery industry as "BowJax" were a few of the devices designed to reduce string vibration and noise known to an archer as "string twang". These devices also worked to reduce the overall sound of the bow, but had little affect on limb vibration and hand shock.

Later U.S. Pat. No. 6,298,842 Sims (2001) discloses a damper for archery bow limbs known as the "LimbSaver". This device is mushroom shaped, with a head and integral stem fabricated from a elastomeric polymer known in the archery industry as "NAVCOM". The stem is capable of oscillating over a 360 degree span in directions generally normal to the longitudinal axis of the device. The peripheral part of the head can oscillate around its circumference in directions generally paralleling that axis. U.S. Design Pat. No. D445,161 also depicts this mushroom shaped head and stem arrangement mounted to an archery bow limb.

Other manufactures have also patented archery bow limb dampers, including U.S. Pat. No. 6,684,874 Mizek (2004), U.S. Pat. No. 6,910,472 Mizek (2005) this design is marketed under the name of "ThunderBlox", by NAP. This product is an integral base and body, wherein the body is shaped like an inverted pyramid as it extends away from the base. It is hollow on top with four very small tabs placed inside. These tabs are free to vibrate inside the open hollow space when an arrow is released from an archery bow. The drawback with this design is that the mass of the tabs are negligible.

U.S. Pat. No. 6,712,059 Donovan (2004) describes a device with a base that mounts flat to the bow limb and has a plurality of fins extending up from the base and perpendicular to the surface of the bow limb. The forces placed on a damper of this arrangement act normal to the longitudinal axis of the fins when mounted on a parallel limb bow limiting its effectiveness.

Others also marketed limb damper devices from the following:

Alpine Archery limb dampers,

Diamond Hush Kit,

CSS/Richwood Archery Tuners,

Barrie Archery Hemi limb dampers, and Hoyt Archery Alpha Shox limb dampers.

While some of these devices will work to a certain degree, other devices did little more than add weight to the bow limb and could not do a very good job of vibration dampening due to the stiffness of the materials used. Which leads to another important consideration to take into account, the choice of materials. As now there are elastomeric polymer compounds that are considered gels by their hardness scale that can be injection molded. For a thermoplastic elastomer to be classified as a gel the hardness must be 10 Shore A or less, and into the Shore OO scale. Older gel formulations required long cure times in the mold, and some required a protective coating to prevent deformation and drying out. These types of gel devices were often used for arm rests and shoe insoles, and would normally never be used as a vibration damper device unless sealed in a container as they were too fragile and susceptible to damage. The recent developments of these newer materials will prove to be far more effective for vibration dampening devices then have ever been realized before.

One prior art of the inventor that seems to work well with parallel mounted limbs is the BowJax LimbJax, it uses four flexible members or arms that have integral balls at the distal end of arms. When an arrow is released from the bow, the four balls rebound against the surface of the bow limb canceling out vibrations. While this arrangement seems to work very effectively on solid limb bows with parallel mounted limbs, it still could use some improvement for use on a split limb bow. Most split limb bows have the limbs spaced too far apart for the balls to make contact with the limbs, plus the height of the disc shaped mount used to fasten the damper to the limbs limit the effectiveness of the device.

SUMMARY OF THE INVENTION

The object of the invention is to provide a vibration dampening device that can be deployed on both split limb bows as well as solid limb bows. One preferred embodiment that seems to work well needs only to have damper device rotated 90 degrees when attaching to the bow limb. It will be apparent to the reader skilled in the art that when mounting on a solid limb, the hemispherical contacts will be placed for maximum coverage on limb. Likewise, when mounting damper device on split limb, it will need to be rotated to achieve this maximum coverage on each side of limb. Through experiments with high speed photography it has been observed that the movable members of the Limbjax move very close to the same frequency. It was further observed that balls at end of arms could not reach the surface of the split limb because of the interference with the split limb mount. One preferred embodiment would incorporate four outboard movable members of the same length and longer than inventors prior art, with two shorter members, each placed 35 degrees between the longer members. This would allow the members to oscillate at different frequencies to further enhance the vibration dampening characteristics of the device. This new invention has been observed to be superior to inventors prior art, especially for split limb bows as the problems of a large gap between limbs and the interference of the split limb mount is now negated. The invention discloses a vibration damper which is molded as a single piece of a soft, flexible elastomeric polymer with a central hub and through hole to accept a mount for placing said damper on either solid limb or split limb bows. The invention further discloses a vibration damper that when mounted to either solid limb or split limb bows by means of a mechanism described herein would greatly reduce sound, vibration, and perceived hand shock when an arrow is released from an archery bow. The device is also constructed from a thermoplastic elastomer compound with a hardness range between 30 Shore OO to 13 Shore A.

DETAILED DESCRIPTION OF PREFERRED EMBODIMENTS

Figure 1:
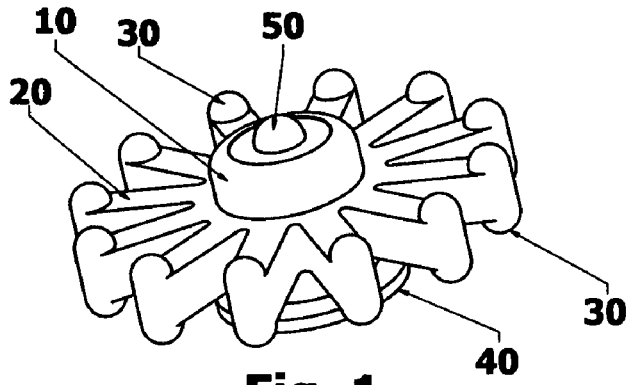
FIG. 1 is a perspective view of device for dampening limb vibrations from one preferred embodiment of the invention for mounting on a solid limb bow.
Figure 2:
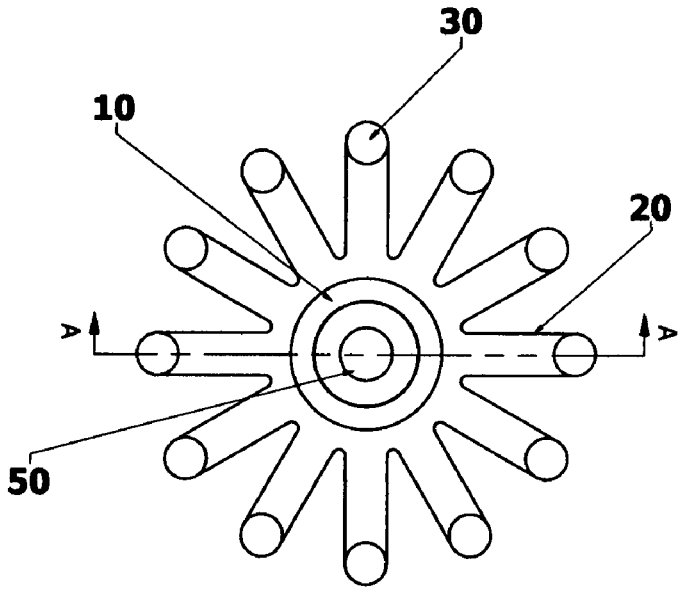
FIG. 2 is a top view of a device from FIG. 1.
Figure 3:
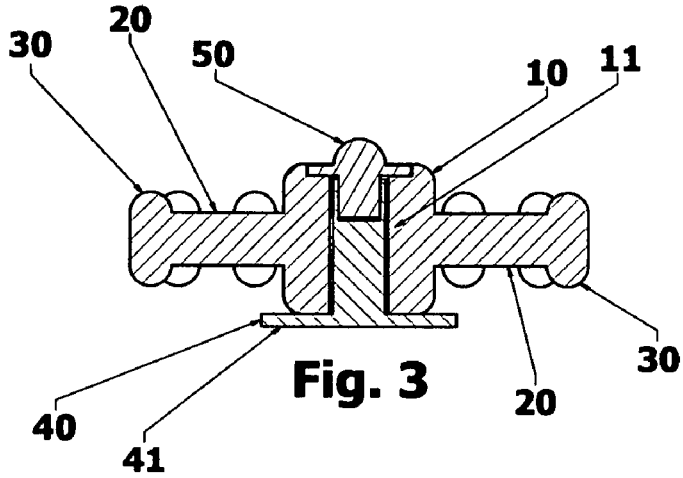
FIG. 3 is a sectional view of device from FIG. 1.

FIGS. 1-3 show a device 10 for reducing vibration and shock in a solid limb archery bow according to one preferred embodiments of this invention. This embodiment show device with twelve arms 20 with hemispherical contacts 30 top and bottom of arms 20. The bottom contact 30 is the one that makes contact with the limb when an arrow is released from an archery bow, the top is for cosmetic purposes as well as adding mass to the end of the arms 20. FIG. 3 shows the cross sectional view of the invention. Integrated base and stem 40 is inserted through the passage 11 of the body 10 and held in place by the retaining cap 50. The integral base and stem 40 are of a rigid plastic allowing only the arms 20 with hemispherical contacts 30 from device 10 to move. This version of the preferred embodiment uses an adhesive or double stick tape to mount to a solid limb bow, the adhesive or tape is placed on the flat bottom of base 40 at 41.

Figure 4:
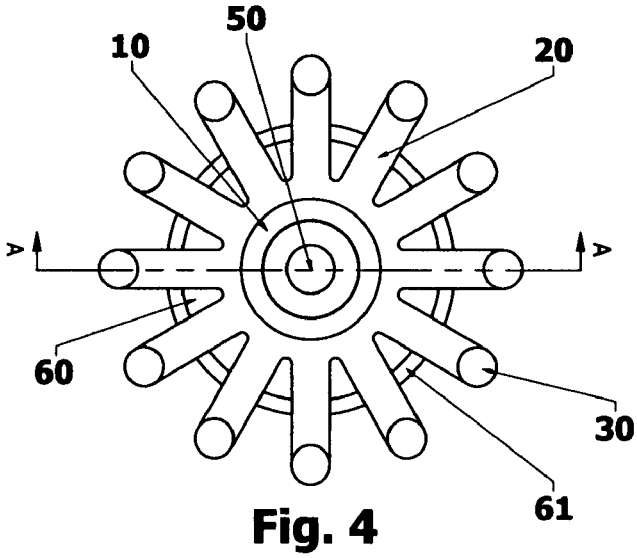
FIG. 4 is a top view of a device for dampening limb vibrations from one preferred embodiment of the invention with mounting for a split limb bow.
Figure 5:
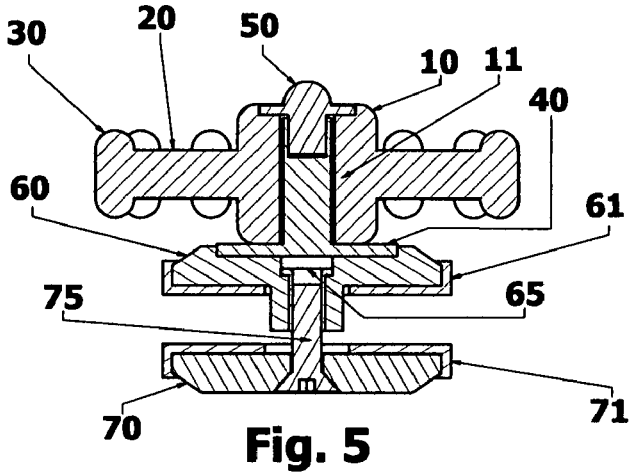
FIG. 5 is a sectional view of device shown in FIG. 4.
Figure 6:
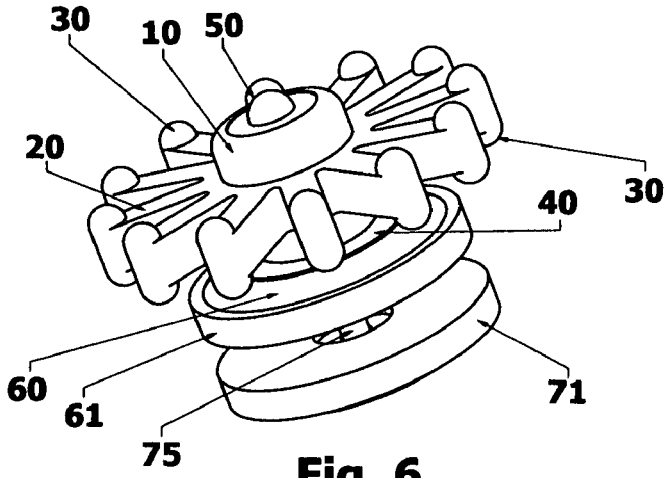
FIG. 6 is a perspective view of device shown in FIG. 4.

FIGS. 4-6 show a device 10 for reducing vibration and shock in a split limb archery bow according to one preferred embodiments of this invention. The previous device 10 described in FIGS. 1-3 is further mounted to an assembly for installing device 10 on a split limb. This assembly uses one disc 60 which is attached to integral base and stem 40 by adhesive, double stick tape or ultrasonic welding. Disc 60 contains a threaded female insert 65 and is covered with a soft polymer disc cover 61 to place between 60 and the limb to prevent wear on the bow limb finish. The bottom disc cover 71 is placed against other side of limb to protect finish and contains disc 70. Disc 70 has an included eighty-two degree counter sink for the flat head screw 75. When the two discs 60 and 70 are aligned the flat head screw 75 is threaded into insert 65 and when tightened, clamps discs to split limb. The soft polymer disc covers 61 and 71 help to keep device from moving on the limb when in use without having to over tighten flat head screw 75.

Figure 7:
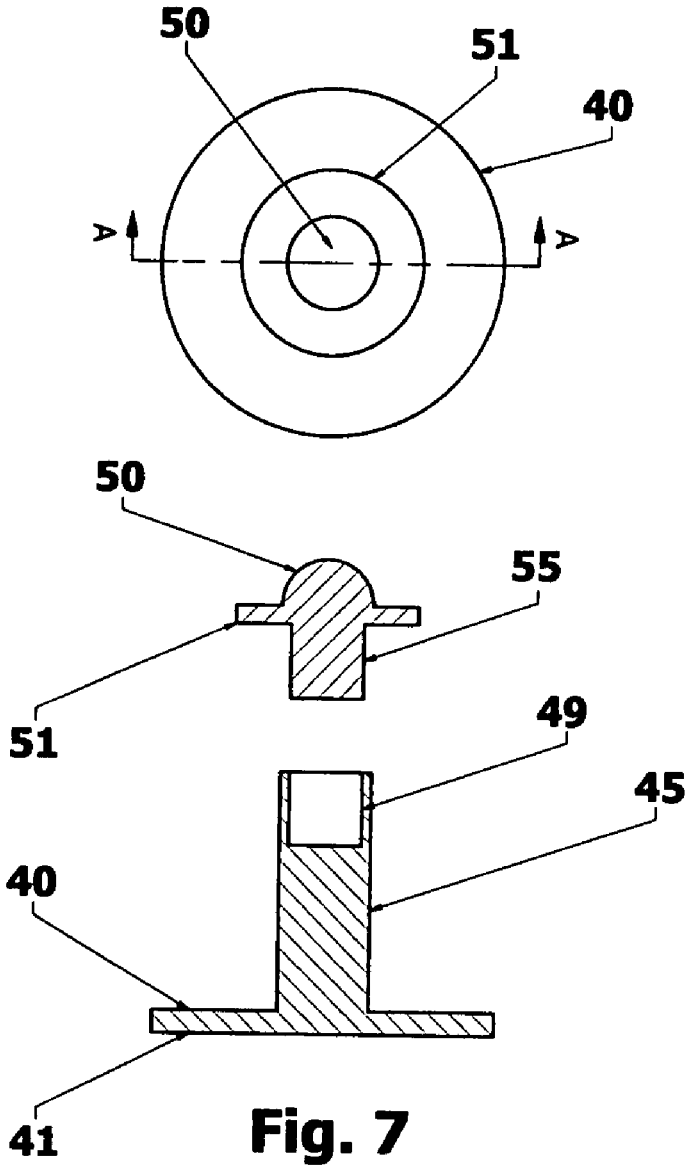
FIG. 7 is a sectional view of integral base and stem to receive device from one of the preferred embodiments disclosed.
Figure 8:
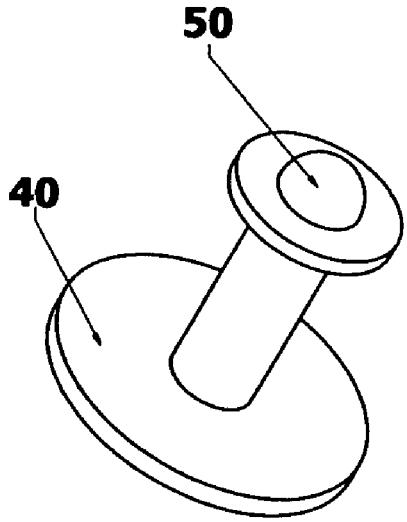
FIG. 8 is an perspective view of FIG. 7.

FIGS. 7-8 show the integral base and stem 40 used to attach device 10 to a solid limb bow or the split limb assembly. The integral base and stem 40 and retaining cap 50 are injection molded out of a rigid plastic known as ABS. The stem 45 is inserted through the passage 11 of the device 10, then held in place by the retaining cap 50. The retaining cap 50 has a large enough diameter flange 51 to prevent device 10 from slipping off base and stem 40. The protruding portion 55 of the retaining cap 50 is glued into hollow end 49 of base and stem 40. The bottom surface of base 40 at 41 uses adhesive methods described to attach directly to the solid limb of a bow, or attach to top side of disc 60 to install on a split limb bow. Since the base and stem 40 are of a hard plastic, only the arms 20 from device 10 are allowed to move when an arrow is released from an archery bow.

Figure 9:
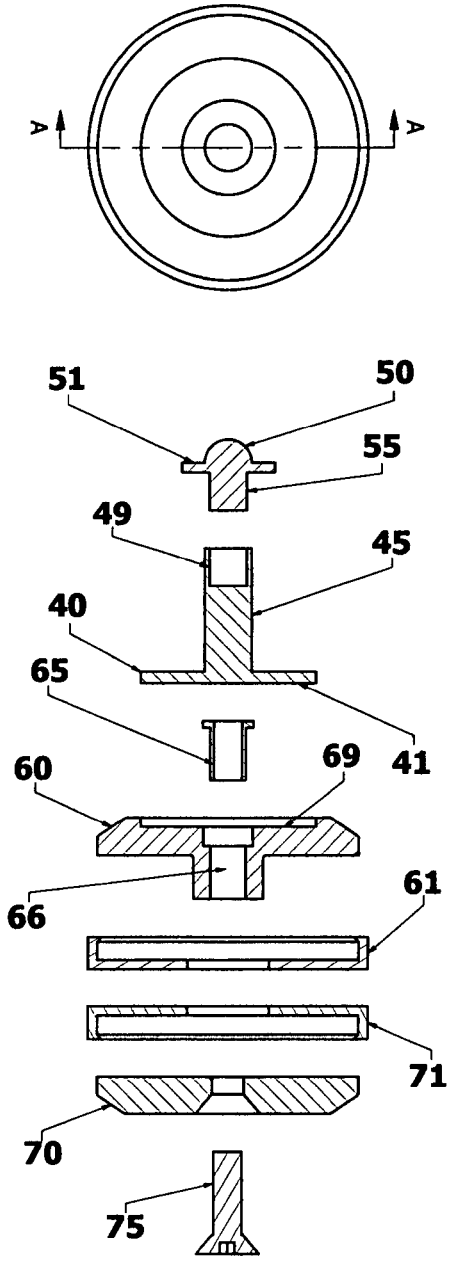
FIG. 9 is an exploded sectional view of split limb mount.

FIG. 9 is an exploded sectional view showing how all of the components are placed together for mounting device 10 onto a split limb bow. From the top down, retaining cap 50 securely holds device 10 onto integral base and stem 40. Threaded female insert 65 is first pressed into hole 66 of disc 60, then bottom of base 40 at 41 is fastened into the counter bore 69 on the top side of disc 60 using one of the adhesive methods described. Disc covers 61 and 71 go between the top and bottom surfaces of the limbs and the discs 60 and 70 to prevent wear on the finish of the bow limbs. This also prevents the discs from sliding on the limbs without over tightening flat head screw 75. The discs 60 and 70 are injection molded out of glass filled ABS and are very rigid to span across the gaps encountered in most split limb bows.

Figure 10:
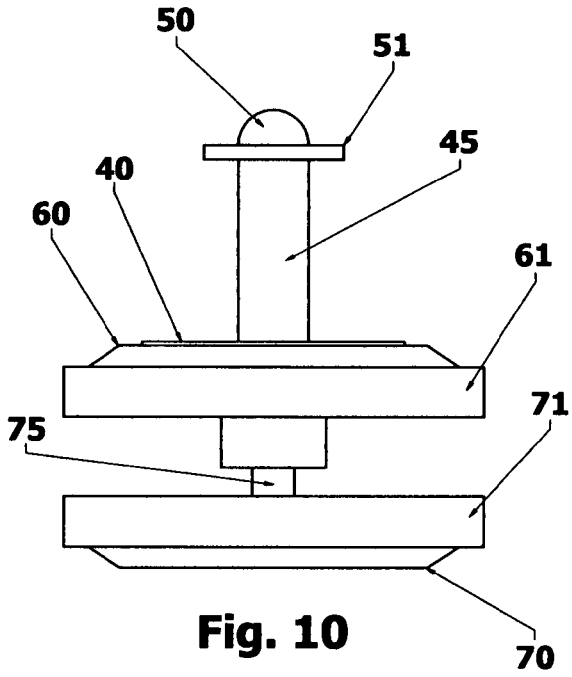
FIG. 10 is a side view of assembled device shown in FIG. 9.
Figure 11:
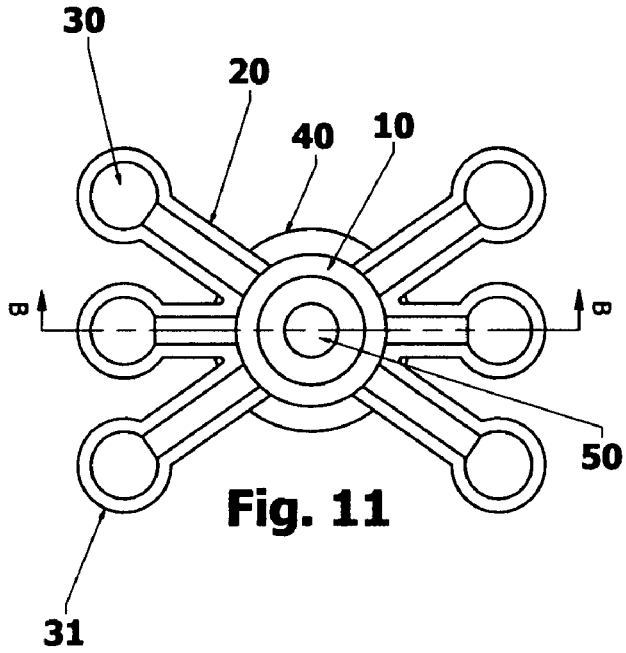
FIG. 11 is a top view of a device for dampening limb vibrations from one preferred embodiment of the invention for mounting on a solid limb.
Figure 12:
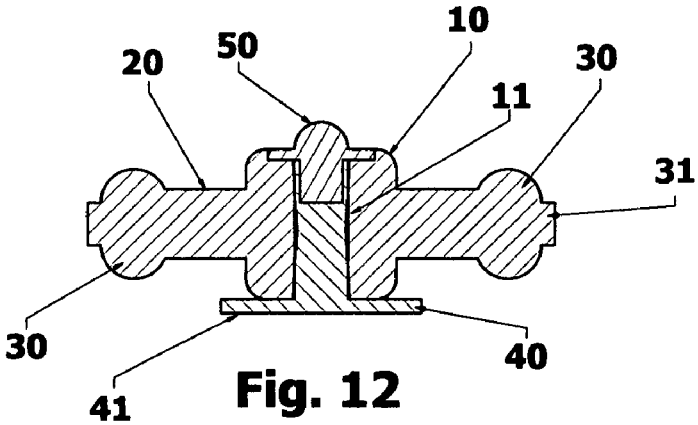
FIG. 12 is a sectional view of device from FIG. 11.
Figure 13:
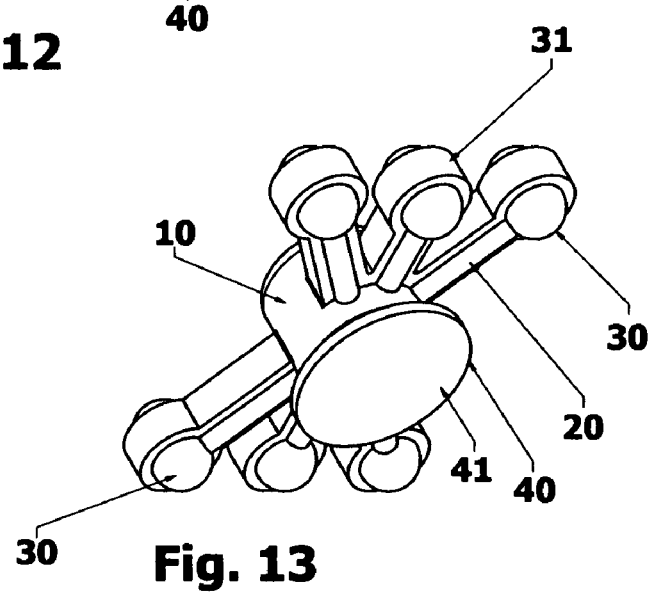
FIG. 13 is a perspective view of device as seen from the bottom from FIG. 11.
Figure 14:
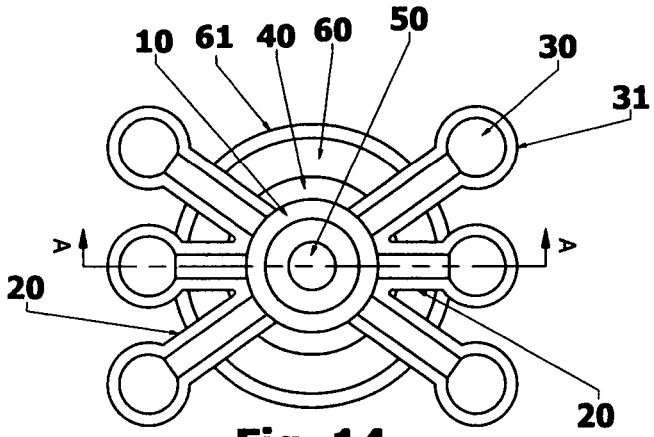
FIG. 14 is a top view of a device for dampening limb vibrations from one preferred embodiment of the invention with mounting for a split limb bow.
Figure 15:
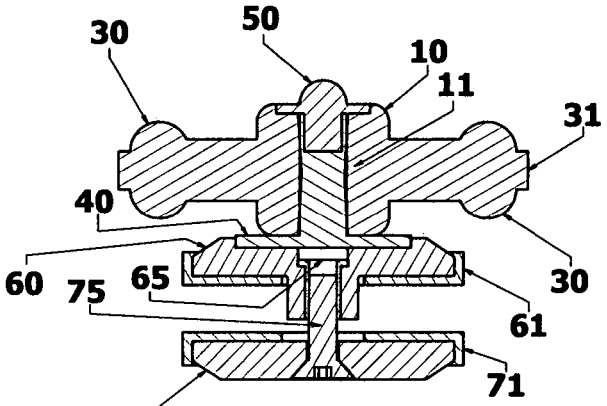
FIG. 15 is a sectional view of device from FIG. 14.
Figure 16:
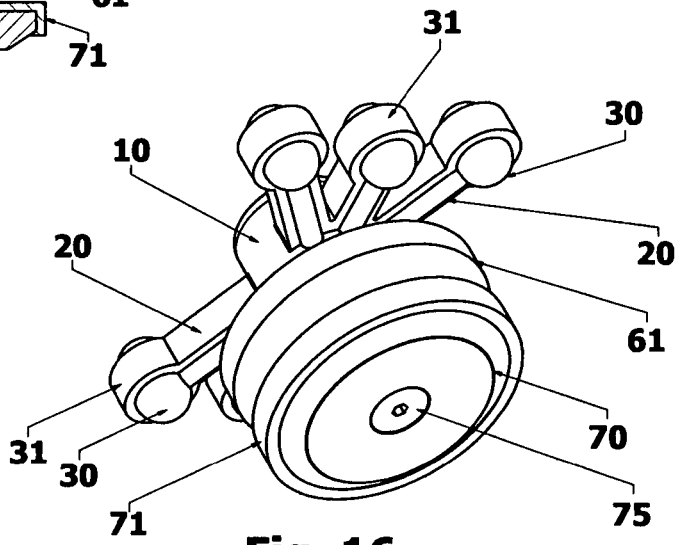
FIG. 16 is a perspective view of device as seen from the bottom from FIG. 14.
Figure 17:
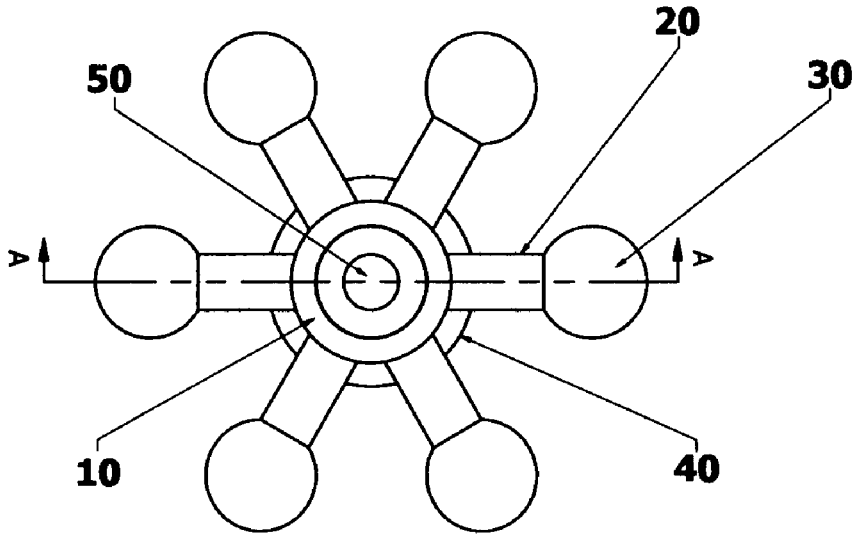
FIG. 17 is a top view of a device for dampening limb vibrations from one preferred embodiment of the invention for mounting on a solid limb bow.
Figure 18:
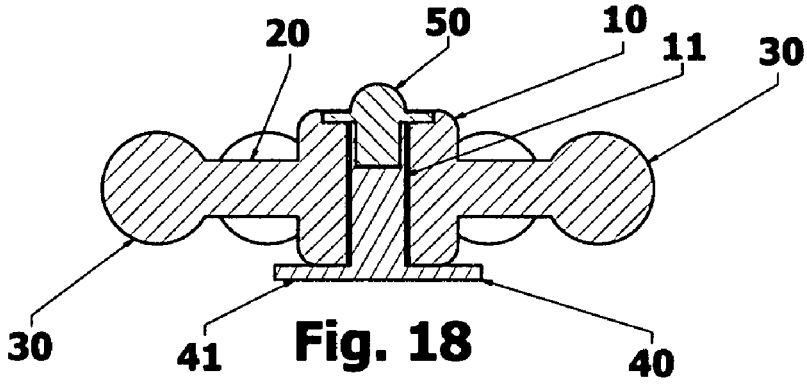
FIG. 18 is a sectional view of device from FIG. 17.
Figure 19:
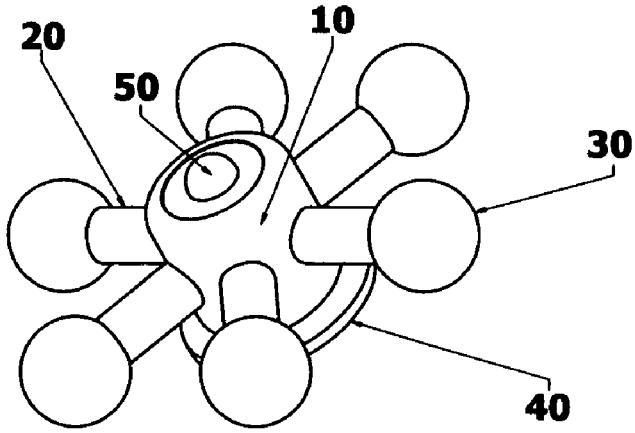
FIG. 19 is a perspective view of device from FIG. 17.
Figure 20:
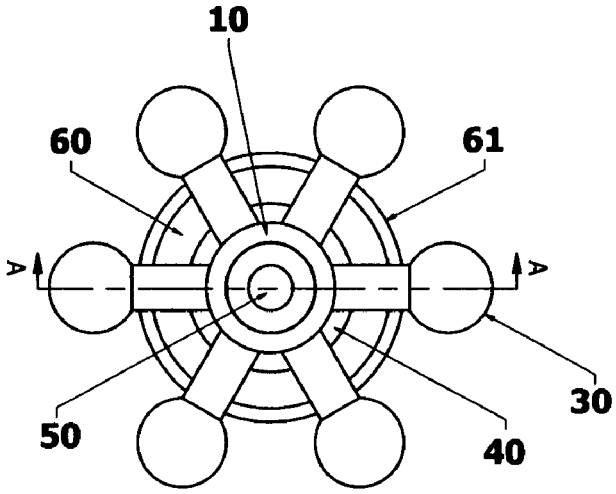
FIG. 20 is a top view of device for dampening limb vibrations from one preferred embodiment of the invention with mounting for a split limb bow.
Figure 21:
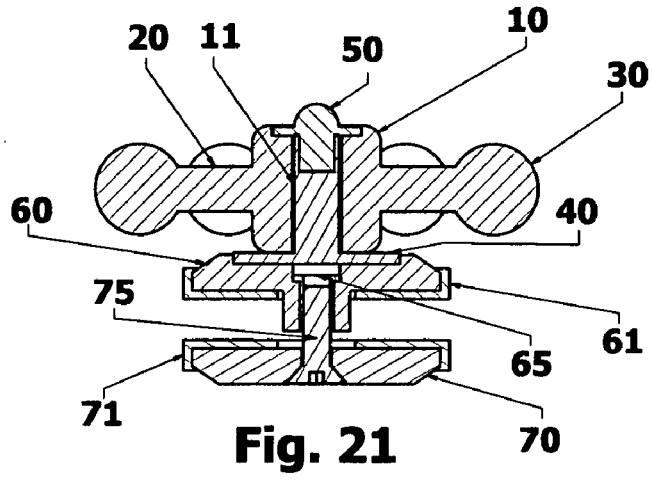
FIG. 21 is a sectional view of device from FIG. 20.
Figure 22:
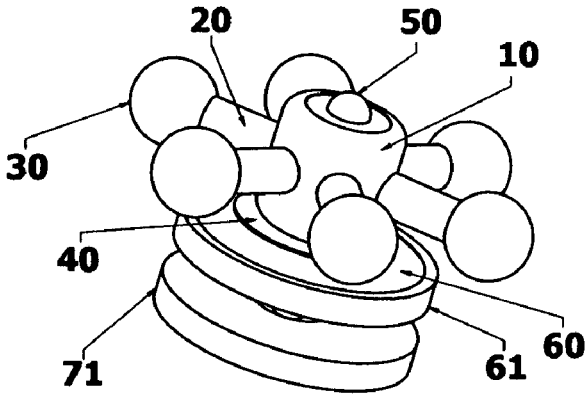
FIG. 22 is a perspective view of device from FIG. 20.

FIG. 10 is an assembled side view of the mount from FIG. 9 for attaching one of the preferred embodiments of device 10 onto a split limb bow.

FIGS. 11-16 show a device 10 of one preferred embodiment for reducing vibration and shock in an archery bow limb, solid or split. This embodiment shown has four arms 20 that are of equal length, with two shorter arms 20 so that the arms 20 vibrate of phase when an arrow is released from an archery bow. As can be seen from the views, the integral mass 31 at the end of arms 20 adds more weight to the end of the arms 20. This feature puts more mass in contact with the limbs at contact points 30. The configuration of device 10 allows it to work well on solid limb bows and split limbs bows by simply rotating device 10 ninety degrees. The long arms 20 can reach out to the split limbs on either side of device 10, likewise the arms 20 would be two long to be placed the same way on a solid limb bow as the hemispherical contacts 30 would miss the limb. When rotated ninety degrees then the contacts 30 make full contact to the limb surface. This preferred embodiment lends itself to more versatility as one size fits both solid and split limb bows.

FIGS. 17-22 show a device 10 of one preferred embodiment for reducing vibration and shock in an archery bow limb, solid or split. The embodiment presented in these views has much larger spherical masses 30 attached to arms 20. The device 10 shown also has round arms 20, but arms 20 can be any cross-sectional shape. The much larger mass of this preferred embodiment puts more elastomeric material in contact with the excited surface of the bow limbs. The integral base and stem 40 with retainer cap 50 holds device 10 securely. Since the base and stem 40 are rigid plastic only the flexible elastomeric polymer arms 20 allow the spherical masses 30 to bounce against and away from the bow limbs when an arrow is released from an archery bow.

Figure 23:
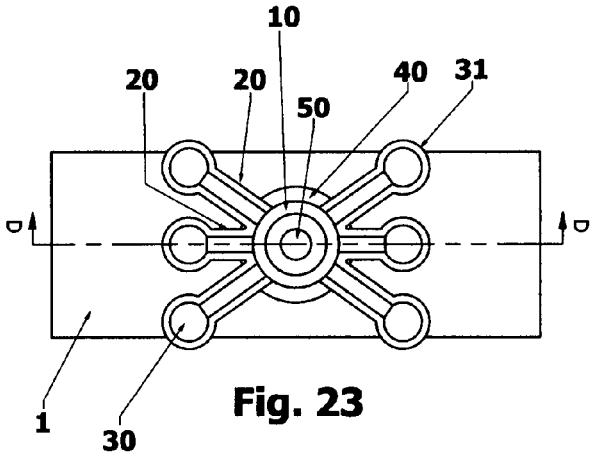
FIG. 23 is a top view of one preferred embodiment from FIGS. 11 thru 13 mounted to the surface of a section of a solid limb for demonstration.
Figure 24:
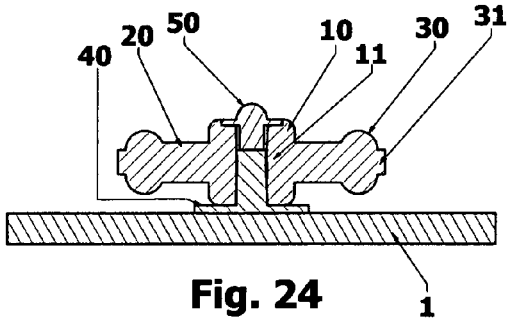
FIG. 24 is a sectional view from FIG. 23 of the device on a solid limb.

FIGS. 23-24 shows the device 10 from one preferred embodiment for reducing vibration and shock mounted on a section of a solid limb 1 as seen from the top and sectional views. The limb 1 is sectioned along the longitudinal axis of the limb 1. As can be seen in FIG. 24 the arms 20 and mass 31 and contact 30 are free from limb running parallel to the surface of the limb 1. The central hub of device 10 is held on the rigid base and stem 40 through the passage 11 so that this portion of the device 10 cannot flex. The arms 20 are free to move when an arrow is released from an archery bow, allowing the mass 31 with the hemispherical contacts 30 to rebound against the surface of the excited surface of the bow limb 1. FIG. 23 illustrates how the device needs to be placed to allow the best coverage on a solid limb bow.

Figure 25:
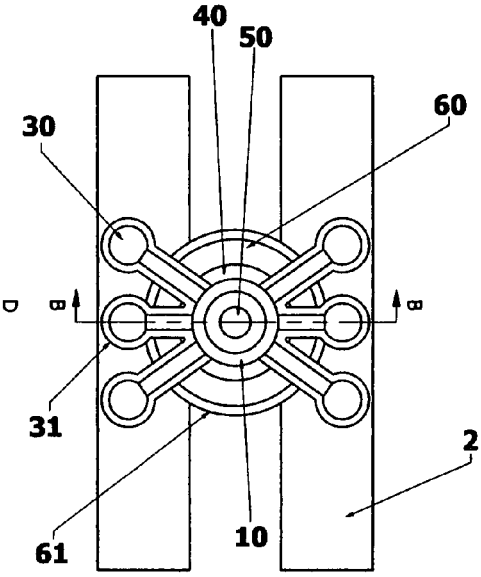
FIG. 25 is a top view of one preferred embodiment from FIG. 14 thru 16 mounted to the surface of a section of a split limb for demonstration.
Figure 26:
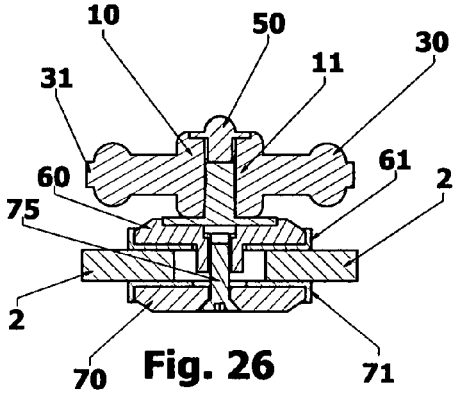
FIG. 26 is a sectional view of device from FIG. 25 showing how device is attached across the split limbs.

FIGS. 25-26 show the device 10 from one preferred embodiment for reducing vibration and shock mounted on a section of a split limb 2 as seen from the top and sectional views. The sectional view illustrates how the rigid discs 60 and 70 span the gap between the split limbs 2. The device 10 is centered between the split limb 2 and the flat head screw 75 is tightened to securely hold device 10 to the split limbs 2. Notice that the device 10 of this preferred embodiment is attached with the shorter arms 20 perpendicular to the longitudinal axis of the split limbs 2. As in FIGS. 23-24 the arms 20 and masses 31 and contacts 30 are parallel to the surface of limb 2 and do not touch the limb 2 until an arrow is released from an archery bow, at which time the contacts 30 rebound against the bow limb 2.

Figure 27:
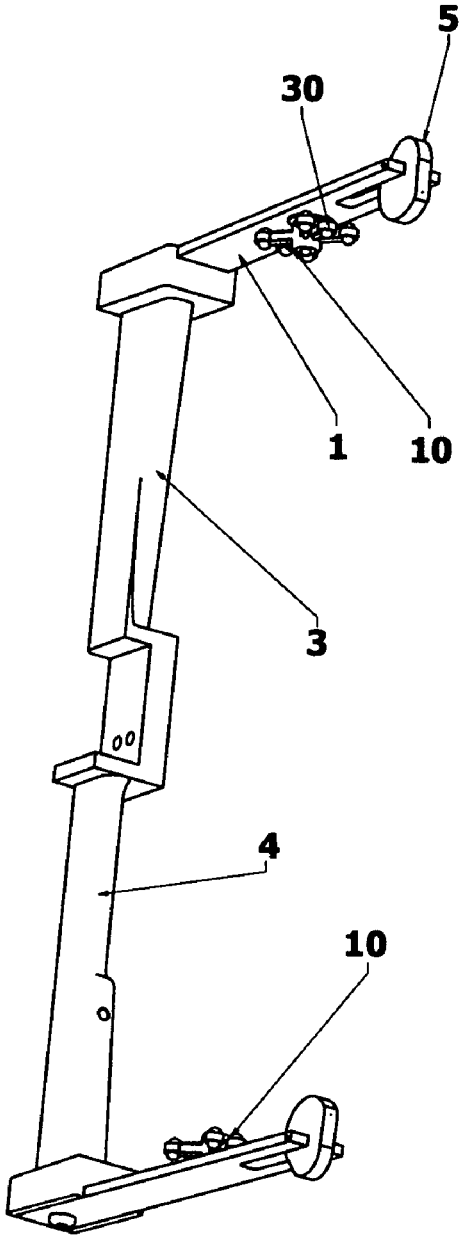
FIG. 27 is a perspective view of one of the preferred embodiments mounted on both top and bottom limbs of a solid limb bow. Bowstrings and cables as well as other accessories are left out of view as they are not relevant to the invention.
Figure 28:
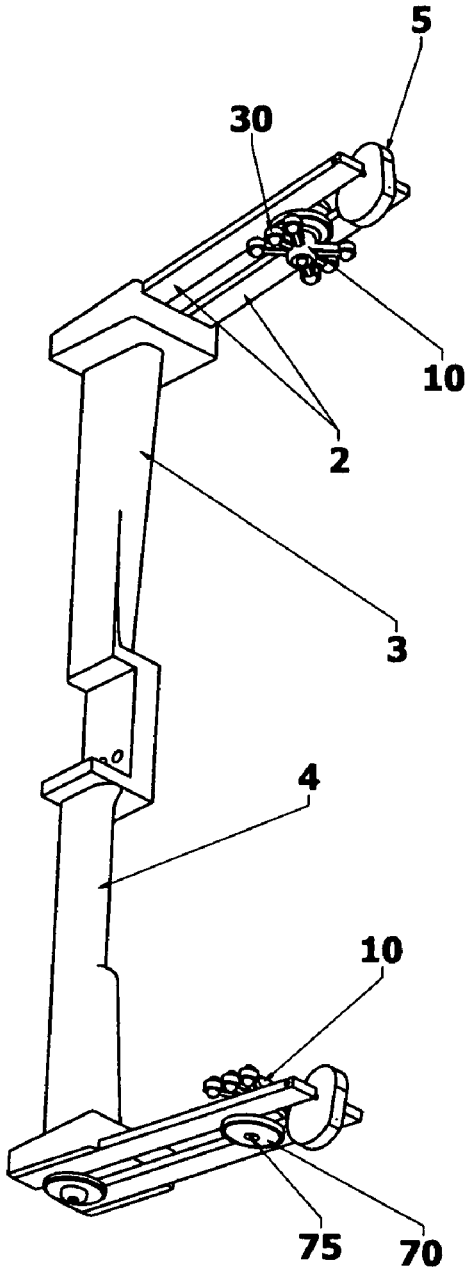
FIG. 28 is a perspective view of one of the preferred embodiments mounted on both top and bottom limbs of a split limb bow.

FIGS. 27-28 show two devices 10 from one preferred embodiment for reducing vibration and shock mounted on both a solid limb 1 bow from FIG. 27 and a split limb 2 bow from FIG. 28. The limbs 1 and 2 are fastened to the bow riser 3 using bolts. As can be seen from these views the device 10 is mounted on the inner side of limbs 1 and 2 in the same general location top and bottom. Although the devices could be mounted to the other sides of the limbs 1 and 2, they are most effective when mounted as shown due to the forces acting on the limbs 1 and 2 when an arrow is released from an archery bow. In FIGS. 27-28 the bow riser 3 is held by the handle 4, as the bow is drawn back the cams 5 roll over and the limbs 1 and 2 flex toward each other. When the arrow is released the device 10 rebounds its members against the bow limbs 1 and 2 when the limbs come to an abrupt stop at their undrawn state. The string and cables as well as accessories are left out of the views as they are not relevant to the invention.

Figure 29:
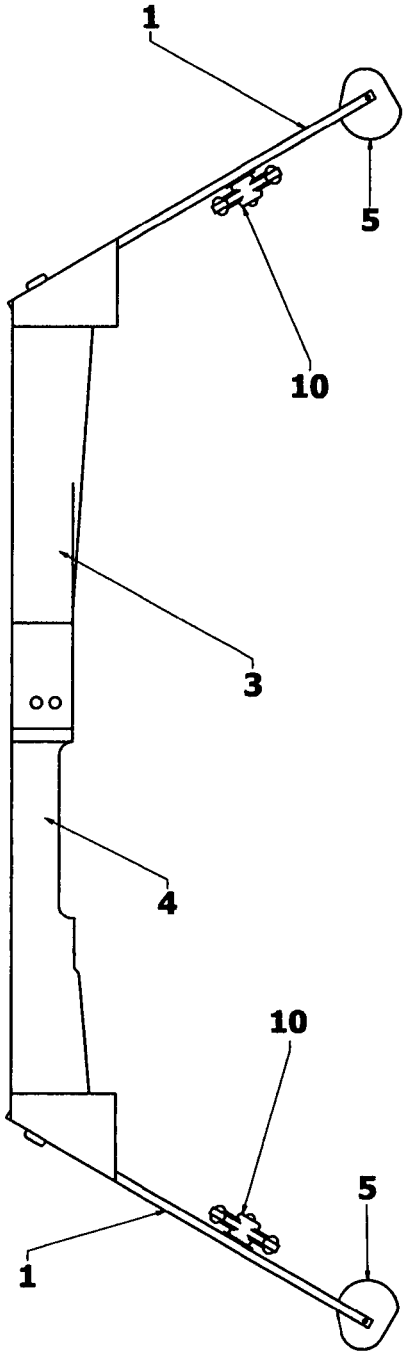
FIG. 29 is a side view of an archery bow with a more conventional limb arrangement with one of the preferred embodiments attached to each limb.
Figure 30:
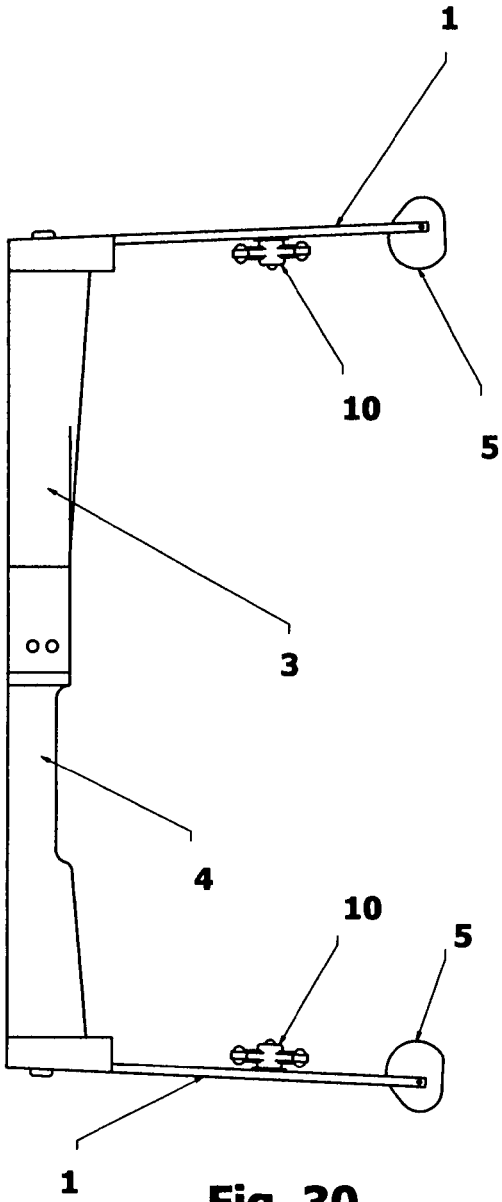
FIG. 30 is a side view of a more modern archery bow with a parallel limb arrangement with one of the preferred embodiments attached to each limb.

FIGS. 29-30 show the difference between a conventional bow limb arrangement and a more modern parallel limb arrangement. From FIG. 30 although exaggerated, more bows these days are going toward a perfect parallel limb arrangement. When these modern bows are drawn back to full draw the limbs actually go beyond parallel. This arrangement was originally conceived as a way for the forces in the limbs to cancel each other out thus reducing vibration, hand shock and noise. There still exists a need for a device 10 like one of the preferred embodiments described be mounted on the limbs 1.

The drawings and descriptions represent only some of the embodiments of the invention. It is realized that skilled persons will understand that there are many ways to make a vibration damper according to the principles disclosed with additional embodiments without departing from spirit and scope of the claims.

Inventor: Wright; Stuart D. (Hayden Lake, Id.); Wright; Becky L. (Hayden Lake, Id.)

Assignee: BowJax, Inc. (Hayden Lake, Id.)

Application No.:

Filed: Apr. 15, 2006

Current U.S. Class: 124/89

Intern'l Class: F41B 005/20

Field of Search: 124/89; 124/92

References Cited

| | | |
|---|---|---|
| 5,362,046 | November, 1994 | Sims |
| 5,421,574 | June, 1995 | Yamagishi |
| 5,611,325 | March, 1997 | Kudlacek |
| 5,617,664 | April, 1997 | Troncoso |
| 5,735,257 | April, 1998 | Walk |
| 5,772,541 | June, 1998 | Buiatti |
| 6,237,584 | May, 2001 | Sims |
| 6,257,220 | July, 2001 | McPherson |
| 6,298,842 | October, 2001 | Sims |
| 6,382,201 | May, 2002 | McPherson |
| 6,526,957 | March, 2003 | Leven |
| 6,588,414 | July, 2003 | McMillan, III |
| 6,681,755 | January, 2004 | Pujos |
| 6,684,870 | February, 2004 | Land |
| 6,684,874 | February, 2004 | Mizek |
| 6,712,059 | March, 2004 | Donovan |
| 6,758,205 | July, 2004 | Kronfeld |
| 6,761,158 | July, 2004 | Wright |
| 6,817,352 | November, 2004 | Saunders |
| 6,910,472 | June, 2005 | Mizek |
| 6,941,937 | September, 2005 | Wheeler |

OTHER REFERENCES CITED

Alpine Archery limb dampers—www.alpinearchery.com

Diamond Hush Kit, from $A_d$ on page 43 Inside Archery December 2005

CSS/Richwood Archery Tuners, from Ad on page 51 of Arrow Trade November 2005

Barrie Archery Hemi limb damper, from Ad on page 99 Bowhunt America October/November 2005

Hoyt Archery Alpha Shox limb dampers, page 5 of Peterson's Bowhunting January/February 2006

What I claim:

1. In combination, a bow which comprises a riser, and limbs extending in opposite directions from opposite ends of said riser; and an elastomeric polymer component operatively associated with at least one of the limbs for modifying the decay pattern of the vibrations set up in the limbs of the bow when an arrow is released;

a further improvement comprising the following:

said component is made from an elastomeric polymer with a hardness less than 13 Shore A;

said elastomeric polymer component includes a central hub with six or more members extending outwardly, with spherical masses at ends of each member distal from the central hub, the spherical masses free to rebound against the surface of a bow limb;

said component including a mechanism for attachment to the surface of a bow limb.

2. The combination of claim 1 wherein said bow is a solid limb archery bow.

3. The combination of claim 1 wherein said bow is a split limb archery bow.

4. In combination:

an archery bow, with a riser, and either a pair of solid limbs with each limb extending from opposite ends of the riser, or two pairs of split limbs with one pair of split limbs extending from each end of the riser;

a device for dampening vibrations in at least one limb of said archery bow, said dampening device molded as a single unit of a soft elastomer with a hardness less than 13 Shore A, and having a cylindrical hub and six or more freely movable arms extending from the circumference of the cylindrical hub;

said dampening device having a passage along the full length of the longitudinal axis of the cylindrical hub, and the arms are arranged perpendicular to the longitudinal axis;

the arms have integral hemispherical contact points of equal size placed at the distal end from the cylindrical hub;

an integral base and stem axially aligned and of sufficient rigidity to receive said dampening device through the longitudinal passage of the cylindrical hub;

a retainer cap to secure said dampening device to the stem opposite from the base;

a mechanism comprising one of (A): an adhesive compound or double stick tape to attach the base to a solid limb of the archery bow, or, (B): two discs of sufficient rigidity and diameter to span the gap between a pair of split limbs, a threaded female insert placed in a first disc and a threaded male fastener to attach the first disc to a second disc and on opposite sides of a pair of split limbs, and a mechanism comprising an adhesive or double stick tape to attach the rigid base to the first disc;

wherein the arms extend out in a plane generally parallel to the surface of a bow limb allowing the hemispherical contacts to rebound against and away from the limb following the release of an arrow from the archery bow to dampen vibrations set up in the limbs.

5. The combination as described in claim 4 where four or more arms of said dampening device are of equal length, and two or more arms of said device are of a shorter length.

* * * * *